US009858851B2

(12) United States Patent
Hung

(10) Patent No.: US 9,858,851 B2
(45) Date of Patent: Jan. 2, 2018

(54) DISPLAY DEVICE AND OPERATION METHOD THEREOF

(71) Applicant: ASUSTeK COMPUTER INC., Taipei (TW)

(72) Inventor: Jie-Chieh Hung, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 107 days.

(21) Appl. No.: 15/084,496

(22) Filed: Mar. 30, 2016

(65) Prior Publication Data

US 2016/0293089 A1 Oct. 6, 2016

(30) Foreign Application Priority Data

Apr. 2, 2015 (TW) ..... 104110891 A

(51) Int. Cl.

| | |
|---|---|
| ***G09G 5/10*** | (2006.01) |
| ***G09G 3/20*** | (2006.01) |
| ***G09G 3/36*** | (2006.01) |
| ***G09G 3/34*** | (2006.01) |
| ***G09G 5/02*** | (2006.01) |

(52) U.S. Cl.

CPC ..... *G09G 3/2018* (2013.01); *G09G 3/2003* (2013.01); *G09G 3/2022* (2013.01); *G09G 3/2096* (2013.01); *G09G 3/3406* (2013.01); *G09G 3/3648* (2013.01); *G09G 5/026* (2013.01); *G09G 2320/0252* (2013.01); *G09G 2320/0613* (2013.01)

(58) Field of Classification Search

CPC .... G09G 3/2018; G09G 5/026; G09G 3/3406; G09G 3/2096; G09G 3/2022; G09G 3/2077; G09G 3/3648; G09G 3/2003; G09G 2320/0252; G09G 2320/0257; G09G 2320/0266; G09G 2320/0271; G09G 2320/045

See application file for complete search history.

(56) References Cited

U.S. PATENT DOCUMENTS

| | | | | |
|---|---|---|---|---|
| 6,075,506 A * | 6/2000 | Bonnett | ..... | G02F 1/133528 345/101 |
| 2009/0051837 A1 | 2/2009 | Xiao | | |
| 2015/0339968 A1 * | 11/2015 | Yoshioka | ..... | G02F 1/1368 345/690 |

FOREIGN PATENT DOCUMENTS

| | | |
|---|---|---|
| CN | 101105915 | 1/2008 |
| CN | 101373582 | 2/2009 |

* cited by examiner

*Primary Examiner* — Adam R Giesy
(74) *Attorney, Agent, or Firm* — JCIPRNET

(57) ABSTRACT

A display device and an operation method thereof are provided. The display device includes a frame scaler, a timing controller, a LCD panel and a source driver. The frame scaler provides a plurality of image data according to an image signal and determines whether the image data are repeatedly transmitted according to a frame control signal. When the image data are repeatedly transmitted, the image data transmitted firstly are set to correspond to gray scale data, and the image data retransmitted are set to correspond to a display image transmitted by the image signal. The timing controller receives the image data to provide a plurality of image display data and receives the frame control signal to determine a data transmission rate of the image display data. The source driver provides a plurality of display voltages to the LCD panel according to the image display data.

16 Claims, 2 Drawing Sheets

DISPLAY DEVICE AND OPERATION METHOD THEREOF

CROSS-REFERENCE TO RELATED APPLICATION

This application claims the priority benefit of TW application serial No. 104110891, filed on Apr. 2, 2015. The entirety of the above-mentioned patent application is hereby incorporated by reference herein and made a part of specification.

BACKGROUND OF THE INVENTION

Field of the Invention

The invention relates to a display device and, more particularly, to an operation method of the display device.

Description of the Related Art

Liquid crystal displays (LCD), rather than a cathode ray tube (CRT) displays, are widely used and become popular in daily life. As the semiconductor technology develops, the LCD has advantages of power-saving, thinner and lighter, high resolution, high color saturation, and long life. Consequently, the LCD is widely used in electronic products, such as a computer or a television.

Conventionally, a response speed of liquid crystal (LC) is low (generally 1 ms~16 ms), when the LCD displays a dynamic image, the LCD utilizing a holding type backlighting module has an image sticking phenomenon due to persistence of vision effect, which is called as a motion blur phenomenon.

BRIEF SUMMARY OF THE INVENTION

According to a first aspect of the present disclosure, a display device, comprising: a frame scaler receiving a frame control signal and an image signal, providing a plurality of image data according to the image signal, and determining whether the image data are repeatedly transmitted in a frame period according to the frame control signal, when the plurality of image data are determined to be repeatedly transmitted, all the plurality of image data transmitted first ate set to correspond to a gray scale data to generate a plurality of first image data, the image data retransmitted are set to correspond to a display image transmitted by the image signal to generate a plurality of second image data, when the plurality of image data are determined not to be repeatedly transmitted, the plurality of image data are set to correspond to the display image to generate a plurality of third image data; a timing controller coupled to the frame scaler to receive the plurality of first image data, the plurality of second image data and the plurality of third image data for providing a plurality of image display data correspondingly, wherein the timing controller receives the frame control signal and determines a data transmission rate of the plurality of image display data according to the frame control signal; a liquid crystal display (LCD) panel; and a source driver coupled to the timing controller and the LCD panel to provide a plurality of display voltages to the LCD panel according to the plurality of image display data.

According to a second aspect of the present disclosure, an operation method of a display device, comprising: receiving a frame control signal and an image signal by a frame scaler to provide a plurality of image data according to the image signal; determining whether the plurality of image data are repeatedly transmitted in a frame period according to the frame control signal by the frame scaler; wherein when the plurality of image data are determined to be repeatedly transmitted, all the image data transmitted first is set to correspond to a gray scale data to generate a plurality of first image data, and the plurality of image data retransmitted are set to correspond to a display image transmitted by the image signal to generate a plurality of second image data; and wherein when the plurality of image data are determined not to be repeatedly transmitted, the plurality of image data are set to correspond to the display image to generate a plurality of third image data.

In conclusion, according to the display device and the operation method disclosed herein, when the frame scaler repeatedly transmits the image data according to the frame control signal, the image data transmitted first is set to correspond to the gray scale data, and the image data retransmitted is set to correspond to the display image of the image signal. As a result, the motion blur phenomenon is reduced or eliminated.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1A:
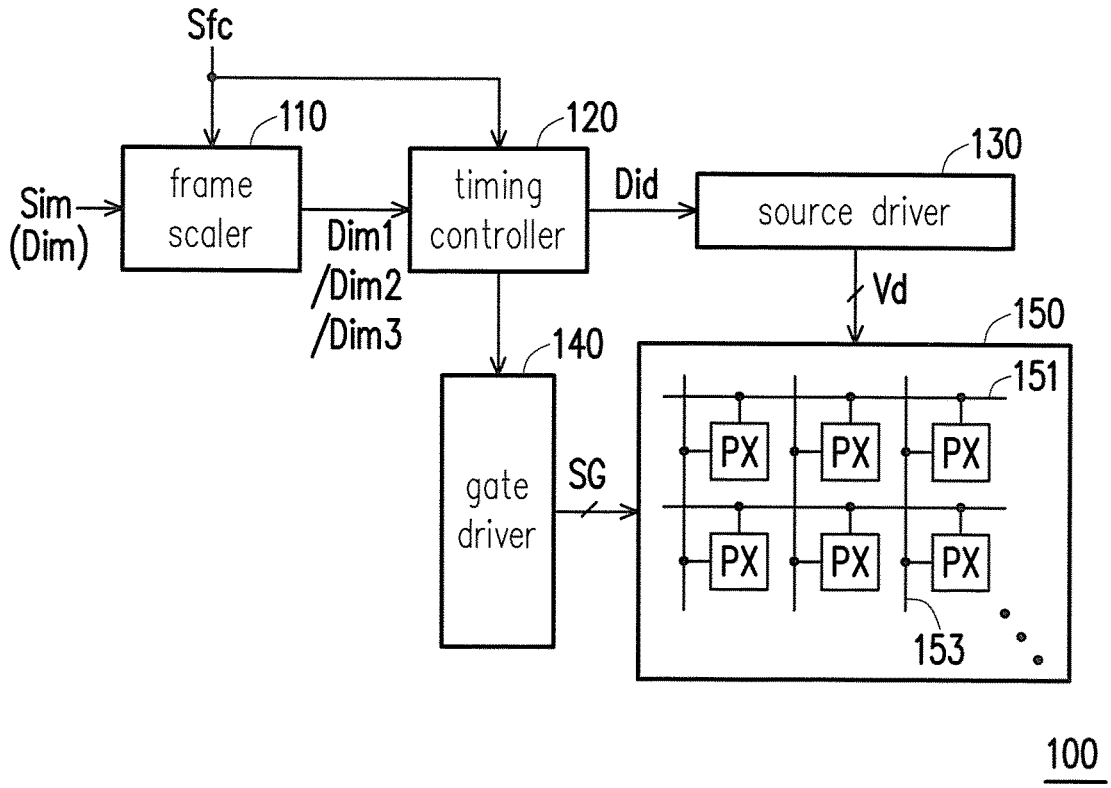
FIG. 1A is a schematic diagram showing a display device system in an embodiment.

FIG. 1A is a schematic diagram showing a display device system in an embodiment. In an embodiment, a display device 100 includes a frame scaler 110, a timing controller 120, a source driver 130, a gate driver 140 and a liquid crystal display (LCD) panel 150. The LCD panel 150 includes a plurality of gate lines 151, a plurality of source lines 153 and a plurality of pixels PX, and each pixel PX is coupled to a corresponding gate line 151 and a corresponding source line 153.

The frame scaler 110 receives a frame control signal Sfc and an image signal Sim, and the frame scaler 110 stores a contrast gain value and a saturation gain value therein. The image signal Sim is used to transmit a display image, and the display image is a color image or a black-and-white image, which is not limited herein. The frame scaler 110 determines whether the image data Dim are repeatedly transmitted by the image signal Sim in a frame period according to the frame control signal Sfc. The frame scaler 110 processes the image data Dim transmitted by the image signal Sim according to the contrast gain value, the saturation gain value, so as to generate a plurality of first image data Dim1, a plurality of second image data Dim2 or a plurality of third image data Dim3, and the frame scaler 110 provides the first image data Dim1, the second image data Dim2 or the third image data Dim3 to the timing controller 120. For example, when the frame control signal Sfc is enabled, the frame scaler 110 repeatedly transmits the image data Dim; when the frame control signal Sfc is disabled, the frame scaler 110 transmits the image data Dim one time.

Figure 1B:
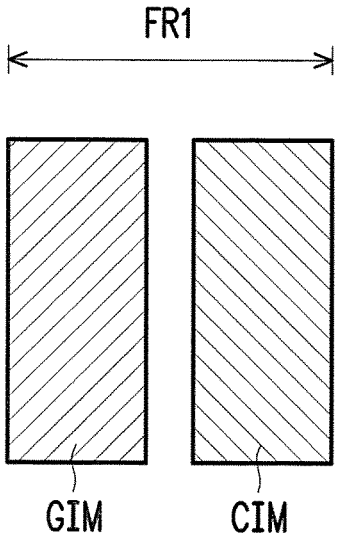
FIG. 1B and FIG. 1C are schematic diagrams showing an image of a display panel in an embodiment.
Figure 1C:
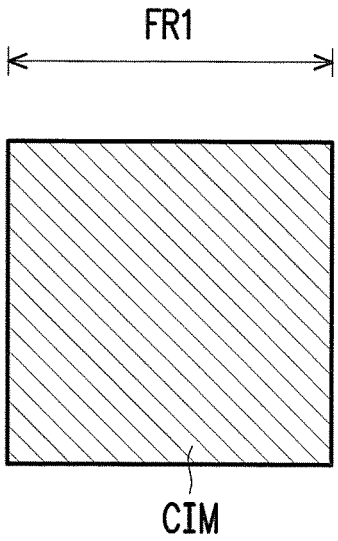

FIG. 1B and FIG. 1C are schematic diagrams showing an image display of a display panel in an embodiment. Please refer to FIG. 1A to FIG. 1B, when the plurality of image data Dim are determined to be repeatedly transmitted (for example, the plurality of image data Dim are transmitted twice), all the image data Dim transmitted in the first time is set to correspond to gray scale data to generate the first image data Dim1, and the plurality of image data Dim retransmitted (that is the plurality of image data Dim transmitted at the second time) are set to correspond to the display image transmitted by the image signal Sim to generate the second image data Dim2. The plurality of first image data Dim1 are used to set that the display panel 150 displays the gray scale image GIM firstly in the frame period FR1, and the plurality of second image data Dim2 are used to set that the display panel 150 displays the display image CIM transmitted by the image signal Sim subsequently in the frame period FR1. Please refer to FIG. 1A to FIG. 1C, when that the plurality of image data Dim are determined not to be repeatedly transmitted (that is the plurality of image data Dim is transmitted one time), the plurality of image data Dim are set to correspond to the display image of the image signal Sim to generate the plurality of third image data Dim3. The plurality of third image data Dim3 is used to set that the display panel 150 just displays the display image CIM transmitted by the image signal Sim in the frame period FR1.

The timing controller 120 is coupled to the frame scaler 110 to receive the plurality of first image data Dim1, the plurality of second image data Dim2 or the plurality of third image data Dim3, so as to provide a plurality of image display data Did. When the timing controller 120 receives the first image data Dim1, the image display data Did correspond to the gray scale data; when the timing controller 120 receives the second image data Dim2 and the third image data Dim3, the image display data Did correspond to the display image CIM of the image signal Sim.

After the timing controller 120 receives the frame control signal Sfc, and then determines a data transmission rate of the image display data Did according to the frame control signal Sfc. Moreover, when the plurality of image data Dim is determined transmitting repeatedly, a processing speed of the timing controller 120 is increased accordingly, and the data transmission rate of the image display data Did is also increased accordingly. Consequently, when the timing controller 120 determines that the image data Dim is repeatedly transmitted according to the frame control signal Sfc, the data transmission rate of the image display data Did is increased, and the multiplying ratio adjusted of the image display data Did is equivalent to the transmission times of the image data Dim. For example, if the image data Dim is transmitted twice, the data transmission rate is doubled of the original data transmission rate; when the timing controller 120 determines that the image data Dim is not repeatedly transmitted according to the frame control signal Sfc, the data transmission rate of the image display data Did is the original data transmission rate (that is the default data transmission rate).

The gate driver 140 is coupled to the timing controller 120 and the LCD panel 150, the gate driver 140 is controlled by the timing controller 120 to provide the gate signal SG to the corresponding gate lines 151 to enable pixels PX line by line. When the image data Dim is determined transmitting repeatedly, the timing controller 120 controls the gate driver 140 to provide the gate signal SG to each gate line 151 repeatedly to enable each pixel PX in the frame period repeatedly. Wherein the number of the enabling time of the pixel PX is equivalent to the number of the transmission time of the image data Dim in the frame period.

The source driver 130 is coupled to the timing controller 120 and the LCD panel 150 to receive the image display data Did. The source driver 130 provides a plurality of display voltages Vd to source lines 153 of the LCD panel 150 according to the image display data Did, each display voltage Vd is transmitted to the corresponding the pixel PX via the source lines 153. When the timing controller 120 receives the first image data Dim1, all pixels PX displays the same color and brightness (for example, all pixels PX display one of 256 levels of gray scales), so as to make the LCD panel 150 display the gray scale image, that is the LCD panel 150 displays any pure image with a gray-scale value; when the timing controller 120 receives the second image data Dim2 or the third image data Dim3, all pixels PX displays the corresponding brightness value after the pixels PX receives the corresponding the display voltage Vd, so as to make the LCD panel 150 display the display image CIM corresponding to the image signal Sim.

In an embodiment, when the image data Dim is repeatedly transmitted, the LCD panel 150 is reset firstly in the frame period (for example, the LCD panel 150 displays blackness), and then the LCD panel 150 is driven to display the display image CIM of the image signal Sim. As a result, the motion blur phenomenon is reduced or eliminated.

In an embodiment, the frame scaler 110 adjusts the image data Dim to correspond to the gray scale data or the display image CIM of the image signal Sim by adjusting the contrast gain value. When the image data Dim are determined to be repeatedly transmitted, the frame scaler 110 sets the contrast gain value corresponding to the image data Dim transmitted firstly to be zero, so as to generate the first image data Dim1 whose contrast gain value is zero, and the contrast gain value corresponding to the image data Dim retransmitted (for example, the image data Dim is transmitted in the second time) is restored to a default contrast value (that is the default contrast gain value) to generate the second image data Dim2 whose contrast gain value is the default contrast value; when the image data Dim are determined not to be repeatedly transmitted, the frame scaler 110 sets the contrast gain value corresponding to the image data Dim transmitted one time as the default contrast value (that is the default contrast gain value), so as to generate the third image data Dim3 whose contrast gain value is the default contrast value.

In an embodiment, the frame scaler 110 adjusts the saturation gain value synchronously. When the image data Dim are determined to be repeatedly transmitted, the frame scaler 110 set the saturation gain value corresponding to the image data Dim transmitted firstly to be zero, so as to generate the first image data Dim1 whose saturation gain value is zero, and the saturation gain value corresponding to the image data Dim retransmitted (for example, the image data Dim is transmitted in the second time) is restored to the default saturation value (that is the default saturation gain value) to generate the second image data Dim2 whose saturation gain value is the default saturation value; when the image data Dim is determined not to be repeatedly transmitted, the frame scaler 110 set the saturation gain value corresponding to the image data Dim transmitted one time as the default saturation value (that is the default saturation gain value), so as to generate the third image data Dim3 whose saturation gain value is the default saturation value.

In an embodiment, the display device 100 determines whether to repeatedly transmit the image data Dim according to the display image CIM of the image signal Sim. For example, when the display image CIM of the image signal Sim is a dynamic image, the display device 100 enables the frame control signal Sfc to control the frame scaler 110 to transmit the image data Dim repeatedly; when the display image CIM of the image signal Sim is a static image, the display device 100 disables the frame control signal Sfc to control the frame scaler 110 not to transmit the image data Dim repeatedly. Moreover, in an embodiment, the frame control signal Sfc is enabled or disabled according to a command from a user, that means, the frame control signal Sfc is turned on or off according to requirements of the user.

Figure 2:
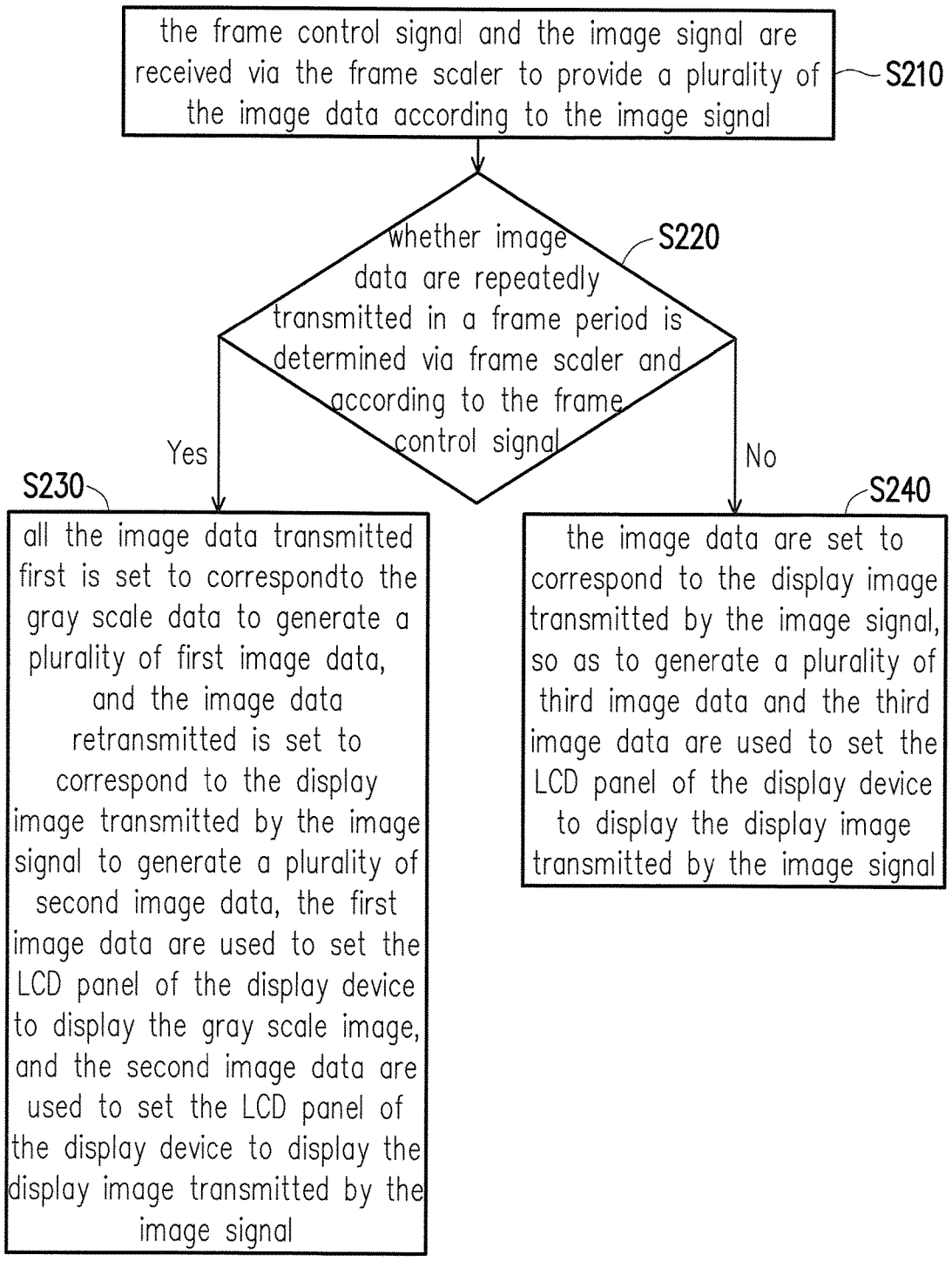
FIG. 2 is a flow chart showing an operation method of a display device in an embodiment.

FIG. 2 is a flow chart showing an operation method of a display device in an embodiment. Please refer to FIG. 2, in the embodiment, the operation method of the display device includes the following steps. In step S210, the frame control signal and the image signal are received via the frame scaler to provide a plurality of image data according to the image signal. Then, whether the image data is repeatedly transmitted in a frame period is determined via the frame scaler according to the frame control signal (step S220). When the image data is determined to be repeatedly transmitted, that is the determination result in step S220 is "Yes", all the image data transmitted firstly is set to correspond to the gray scale data, so as to generate a plurality of first image data, and the image data retransmitted is set to correspond to the color image transmitted by the image signal, so as to generate a plurality of second image data. The first image data is used to set the LCD panel of the display device to display the gray scale image, and the second image data is used to set the LCD panel of the display device to display the display image transmitted by the image signal (step S230). When the image data is determined not to be repeatedly transmitted, that is the determination result of step S220 is "No", the image data is set to correspond to the display image transmitted by the image signal, so as to generate a plurality of third image data. The third image data is used to set the LCD panel of the display device to display the display image transmitted by the image signal (step S240). The sequence of steps of S210, S220, 5230 and S240 are limited herein. The detail of the steps S210, S220, S230 and S240 can refer to the illustration in the embodiments in FIG. 1A to FIG. 1C, which is omitted herein.

In sum, the display device and the operation method thereof are provided. When the frame scaler repeatedly transmits the image data according to the frame control signal, the image data transmitted firstly is set to correspond to the gray scale data, and the image data retransmitted subsequently is set to correspond to the display image of the image signal. As a result, the motion blur phenomenon is reduced or eliminated.

Although the invention has been disclosed with reference to certain preferred embodiments thereof, the disclosure is not for limiting the scope. Persons having ordinary skill in the art may make various modifications and changes without departing from the spirit and the scope of the invention. Therefore, the scope of the appended claims should not be limited to the description of the preferred embodiments described above.

What is claimed is:

1. A display device, comprising:

a frame scaler receiving a frame control signal and an image signal, providing a plurality of image data according to the image signal, and determining whether the plurality of image data are repeatedly transmitted in a frame period according to the frame control signal, when the plurality of image data is determined to be repeatedly transmitted, the plurality of image data transmitted firstly is set to correspond to a gray scale data to generate a plurality of first image data, the image data retransmitted is set to correspond to a display image transmitted by the image signal to generate a plurality of second image data, when the plurality of image data are determined not to be repeatedly transmitted, the plurality of image data are set to correspond to the display image to generate a plurality of third image data;

a timing controller coupled to the frame scaler to receive the plurality of first image data, the plurality of second image data and the plurality of third image data for providing a plurality of image display data correspondingly, wherein the timing controller receives the frame control signal and determines a data transmission rate of the plurality of image display data according to the frame control signal;

a liquid crystal display (LCD) panel; and a source driver coupled to the timing controller and the LCD panel to provide a plurality of display voltages to the LCD panel according to the plurality of image display data.

2. The display device according to claim 1, wherein when the plurality of image data are determined to be repeatedly transmitted, the frame scaler sets a contrast gain value of the first image data to be zero, and sets the contrast gain value of the plurality of second image data to be a default contrast value.

3. The display device according to claim 2, wherein when the plurality of image data are determined to be repeatedly transmitted, the frame scaler sets a saturation gain value of the plurality of first image data to be zero, and sets the saturation gain value of the plurality of second image data to be a default saturation value.

4. The display device according to claim 1, wherein when the frame control signal is enabled, the frame scaler repeatedly transmits the plurality of image data, and when the frame control signal is disabled, the frame scaler transmits the plurality of image data one time.

5. The display device according to claim 4, wherein the frame control signal is enabled when the display image is a dynamic image, and the frame control signal is disabled when the display image is a static image.

6. The display device according to claim 4, wherein the frame control signal is enabled or disabled according to a command.

7. The display device according to claim 1, further comprising:

a gate driver coupled to the timing controller and the LCD panel, and controlled by the timing controller to enable a plurality of pixels of the LCD panel line by line, wherein when the plurality of image data are determined to be repeatedly transmitted, and startup times of the pixels is same to transmission times of the image data in the frame period.

8. The display device according to claim 1, wherein when the plurality of image data are determined to be repeatedly transmitted, an adjustment multiple ratio of the data transmission rate of the plurality of image display data are same to a transmission time of the plurality of image data.

9. An operation method of a display device, comprising:

receiving a frame control signal and an image signal by a frame scaler to provide a plurality of image data according to the image signal;

determining whether the plurality of image data are repeatedly transmitted in a frame period according to the frame control signal by the frame scaler;

wherein when the plurality of image data are determined to be repeatedly transmitted, all the image data transmitted firstly is set to correspond to a gray scale data to generate a plurality of first image data, and the plurality of image data retransmitted are set to correspond to a display image transmitted by the image signal to generate a plurality of second image data; and wherein when the plurality of image data are determined not to be repeatedly transmitted, the plurality of image data are set to correspond to the display image to generate a plurality of third image data.

10. The operation method of the display device according to claim 9, further comprising:

when the plurality of image data are determined to be repeatedly transmitted, a contrast gain value of the first image data are set to be zero via the frame scaler, and the contrast gain value of the second image data are set to be a default contrast value.

11. The operation method of the display device according to claim 10, further comprising:

wherein when the plurality of image data are determined to be repeatedly transmitted, the frame scaler sets a saturation gain value of the plurality of first image data to be zero, and the frame scaler sets the saturation gain value of the plurality of second image data to be a default saturation value.

12. The operation method of the display device according to claim 9, further comprising:

repeatedly transmitting the plurality of image data by the frame scaler when the frame control signal is enabled; and transmitting the plurality of image data one time by the frame scaler when the frame control signal is disabled.

13. The operation method of the display device according to claim 12, wherein the frame control signal is enabled when the display image is a dynamic image, and the frame control signal is disabled when the display image is a static image.

14. The operation method of the display device according to claim 12, wherein the frame control signal is enabled or disabled according to a command.

15. The operation method of the display device according to claim 9, further comprising:

wherein when a plurality of image data are determined to be repeatedly transmitted, startup times of the pixels of the LCD panel of the display device are same to transmission times of the image data in the frame period.

16. The operation method of the display device according to claim 8, further comprising:

wherein when the plurality of image data are determined to be repeatedly transmitted, an adjustment multiple ratio of the data transmission rate of the plurality of image display data is same to a transmission time of the image data.

* * * * *